US007786888B2

(12) United States Patent
Luterotti et al.

(10) Patent No.: US 7,786,888 B2
(45) Date of Patent: Aug. 31, 2010

(54) FALSE CEILING FIRE DETECTOR ASSEMBLY

(75) Inventors: Lorenzo Luterotti, Gorizia (IT); Mauro Ceppa, Muggia (IT)

(73) Assignee: Honeywell International Inc., Morristown, NJ (US)

( * ) Notice: Subject to any disclaimer, the term of this patent is extended or adjusted under 35 U.S.C. 154(b) by 304 days.

(21) Appl. No.: 11/554,225

(22) Filed: Oct. 30, 2006

(65) Prior Publication Data

US 2008/0100460 A1 May 1, 2008

(51) Int. Cl.
*G08B 23/00* (2006.01)

(52) U.S. Cl. ..... 340/693.9; 340/691.1; 250/493.1

(58) Field of Classification Search ..... 340/639.9, 340/577, 578, 628, 691.1; 250/554, 494.1, 250/493.1

See application file for complete search history.

(56) References Cited

U.S. PATENT DOCUMENTS 4,370,557 A * 1/1983 Axmark et al. ..... 250/554
4,518,855 A * 5/1985 Malak ..... 356/141.3
4,701,624 A * 10/1987 Kern et al. ..... 250/554
4,833,458 A * 5/1989 Bowman ..... 340/628
5,577,696 A * 11/1996 Kramer ..... 248/206.5
5,850,182 A * 12/1998 Schuler ..... 340/578
5,886,637 A * 3/1999 Stuckey ..... 340/628
6,929,945 B2 8/2005 Aravanis et al.
2004/0036598 A1 2/2004 Rolf et al.
2004/0129434 A1* 7/2004 Tan ..... 169/37
2004/0144182 A1 7/2004 Gysling et al.
2007/0080819 A1* 4/2007 Marks et al. ..... 340/628

OTHER PUBLICATIONS

Patent Cooperation Treaty International Search Report, Apr. 8, 2008.
Patent Cooperation Treaty Written Opinion of the International Searching Authority, Apr. 8, 2008.
Pittway Tecnologica SRL—"Automatic Fire Detection and Fire Alarm Systems;" UNI 9795, Apr. 2005 (Italian).
English Translation of Paragraphs 5.2.26 and 5.4.4.4 of "Automatic Fire Detection and Fire Alarm Systems;" Pittway Tecnologica SRL, UNI 9795, Apr. 2005.

* cited by examiner

*Primary Examiner*—Davetta W Goins
*Assistant Examiner*—Edny Labbees
(74) *Attorney, Agent, or Firm*—Husch Blackwell Sanders Welsh & Katz

(57) ABSTRACT

A mounting apparatus usable with ambient condition detectors includes first and second mounting bases spaced apart axially along a common center line. Respective detectors can be coupled to the bases as required in a specific installation.

13 Claims, 4 Drawing Sheets

FALSE CEILING FIRE DETECTOR ASSEMBLY

FIELD

The invention pertains to ambient condition detectors. More particularly, the invention pertains to structures which incorporate a plurality of spaced apart detectors for monitoring adjacent separate ambient regions.

BACKGROUND

False ceilings are commonly found in commercial and industrial structures. They are particularly useful in that utilitarian structures such as conduits, brackets, fixtures and the like can be recessed therein but continue to be readily accessible. False ceilings also provide an enhanced aesthetic appearance since all of the necessary utilitarian structures are out of sight in the space between the false or drop ceiling and the true ceiling of the region.

In some instances, fire codes require that sensors be installed in any separate ambient. Regions with a false ceiling constitute two different ambients which may need to be monitored. Hence, not only must ambient condition detectors be mounted on false ceilings, they must also be mounted in the utilitarian region above the false ceiling.

Such recessed or hidden detectors can be inconvenient, expensive, and can create maintenance problems. While such recessed detectors can be readily installed before the false ceilings are installed, they must be readily available after the fact for inspection. A known solution to the problem is to provide an inspection trap door which can also be inconvenient and not cost effective.

There is a continuing need, as a result, for structures or methods which make it possible to readily install and inspect detectors in limited access regions, for example, above false ceilings, in a way which is both cost effective and in accordance with the desired aesthetics of the region. It would also be desirable that such devices and methods do not substantially affect the cost of the associated detectors.

DETAILED DESCRIPTION

Figure 1:
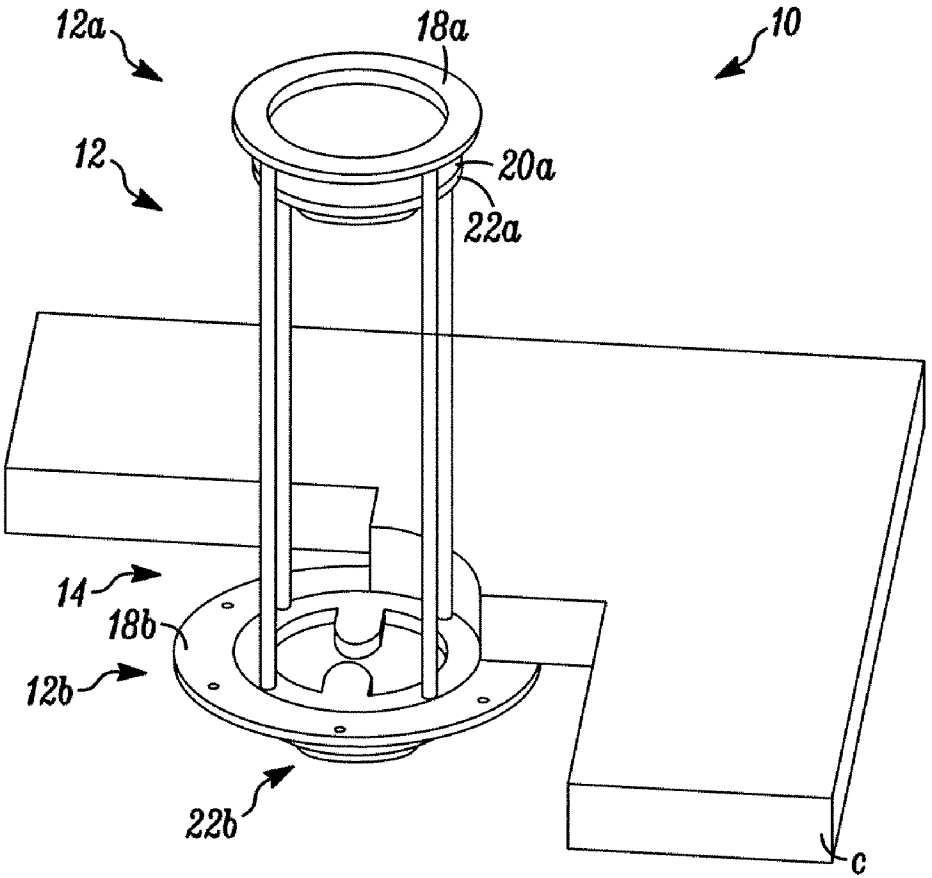
FIG. 1 is an overall perspective-type view of an apparatus in accordance with the invention.

While embodiments of this invention can take many different forms, specific embodiments thereof are shown in the drawings and will be described herein in detail with the understanding that the present disclosure is to be considered as an exemplification of the principles of the invention, as well as the best mode of practicing same, and is not intended to limit the invention to the specific embodiment illustrated.

An apparatus which embodies the invention couples first and second detectors together axially so one of the detectors can be installed such that it extends from a normally visible surface of a false ceiling. In this embodiment, the second, axially displaced, detector is operatively position in the utilitarian space above the false ceiling.

In another aspect of the invention, the detectors can be mounted spaced apart from one another using a plurality of adjustable spacing elements. As a result, the different dimensions of utilitarian spaces above the false ceiling can be taken into account.

Each of the detectors can be releasably mounted on a standard mounting base. The respective bases can be in wired or wireless communication with a regional alarm system. Those of skill will understand that the characteristics and particular details of the associated alarm system are not limitations of the present invention.

In accordance with the invention, the two detectors are installed by attaching one of the two to the associated false ceiling with the other of the two extending axially above the false ceiling into the utilitarian space. Structures which embody the present invention are particularly advantageous in that no inspection trap door is needed and no special double wall base mount is required. Rather, the entire unit can be removed from the ceiling by uncoupling same from the exposed side of the false ceiling. Both detectors are removable at the same time for maintenance and test purposes. Either one can be removed from its respective base and replaced. The entire unit can then be reinstalled by attaching the relevant detector to the mount on the false ceiling.

Structures in accordance with the present invention can be used with a variety of different types of ambient condition detectors. These include, without limitation, smoke, gas, fire, thermal and condensation detectors. It will also be understood that the details of such detectors are not limitations of the present invention.

It will also be understood that support structures in accordance with the invention can be used to support two different types of ambient condition detectors such as a smoke detector and a thermal detector as the application requires. Other combinations of detectors come within the spirit and scope of the present invention.

In yet another aspect of the invention, one of the bases can be replaced with a decorative ceiling plate or a light fixture. In such instances, the detector at the other end, on installation, is located in the utilitarian space between the drop ceiling and the actual ceiling of the region.

FIG. 1 illustrates an apparatus 10 which embodies the present invention. The apparatus includes a support structure 12 having first and second ends 12*a*, 12*b*. The ends 12*a*, 12*b* can be moved toward one another or apart from one another axially as needed on a set of tubular members generally indicated at 14.

End 12*a* carries an annular ring-shaped member 18*a* to which is affixed a base 20*a* for a selected form of ambient condition detector. The form of detector could include without limitation smoke detectors, gas detectors, fire detectors and the like all without limitation.

A selected form of ambient condition detector 22*a* is releasably coupled to the base 20*a*. A second detector 22*b* can be releasably coupled to the base 20*b*.

The configuration 10 can be mounted in a drop ceiling C using the annular member 12*b*. When so configured, detector 22*a* senses conditions in the ambient region on one side of the ceiling, C, whereas the detector 22*b* senses ambient conditions on the other side of the ceiling C. This is a convenient and cost-effective arrangement whereby the region above the ceiling C can be monitored on an ongoing basis using standard detectors. The structure 10 is particularly advantageous in that from an aesthetic and cost-effectiveness point of view it can be readily removed from the ceiling C to provide access to the detector 22*a* for inspection and maintenance purposes. Additionally, unit 10 can be used in a variety of different installations where the drop or false ceiling C is located at different distances from the actual ceiling in that region. The bases 20*a,b* can be moved together or spaced apart as needed.

Figure 2:
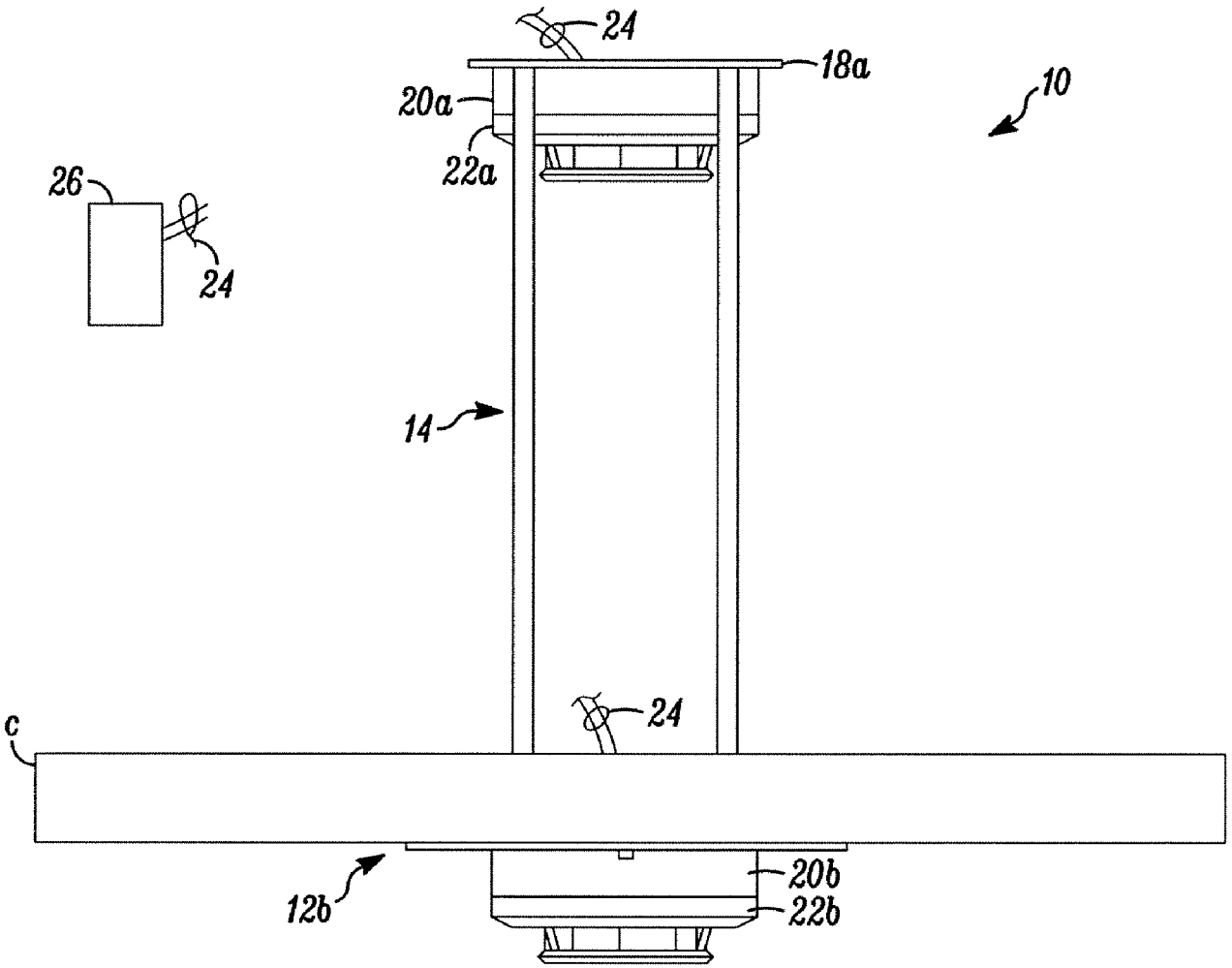
FIG. 2 is a side elevational view of the apparatus of FIG. 1.

Detectors 22*a*, 22*b* can be coupled by medium 24 to a displaced monitoring system 26, illustrated in FIG. 2. It will be understood that neither the medium 24 nor the characteristics of the monitoring system 26 are limitations of the invention.

The medium 24 can be wired or wireless. Additionally, if wired, the electrical conductors, can be either brought directly to each of the bases 20*a, b* or to a terminal block associated with annular ring 18*a* for connection to both detectors. In that embodiment, the apparatus 10 would include conductors which extend from the connector block on the ring 18*a* to the base 20*b*. It will be understood by those of skill in the art that the details of coupling to the bases 20*a, b* are not limitations of the invention.

Figure 3:
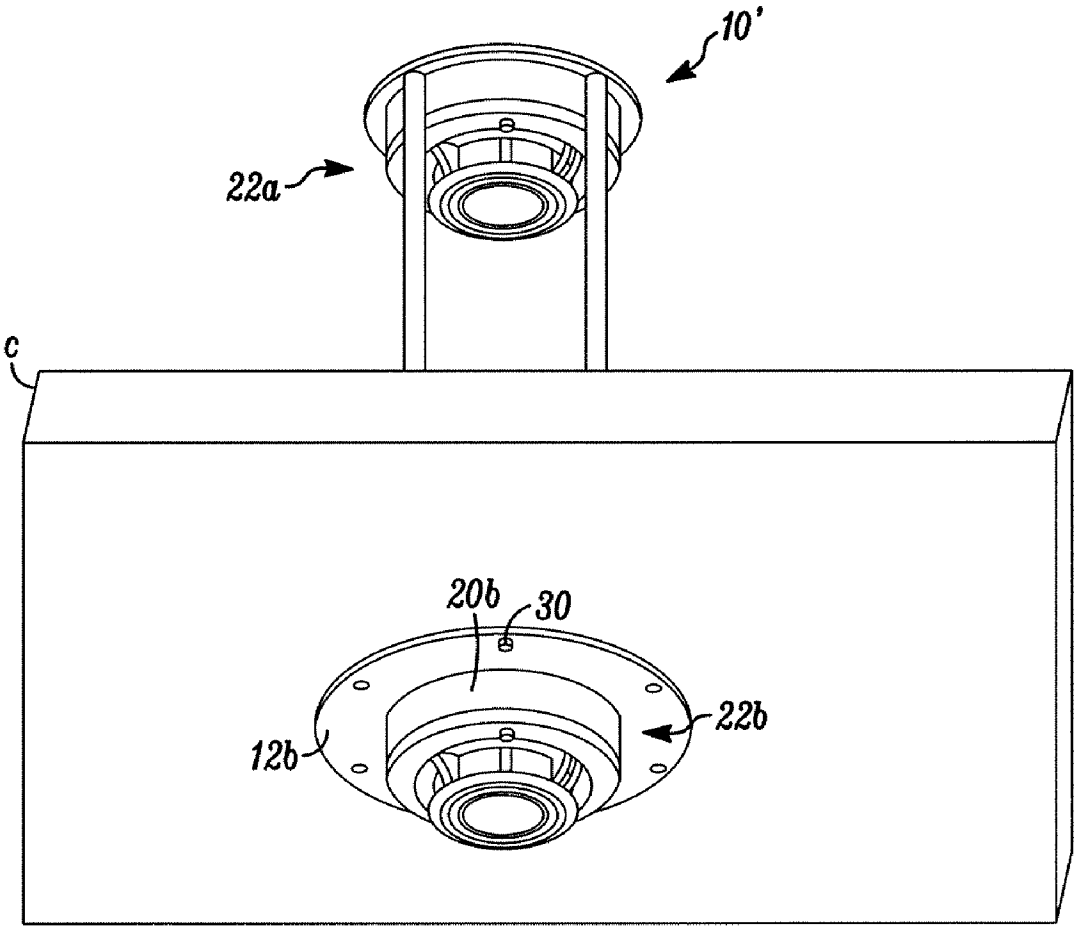
FIG. 3 is yet another view of an apparatus which embodies the invention which is mounted on a drop or false ceiling.

FIG. 3 illustrates an embodiment 10' wherein annular member 12*b* carries an integrated light emitting diode-type indicator 30 which is coupled to the detector 22*a* to provide optical feedback as to the state of that detector. A plurality of different indicators can be mounted on the annular member 12*b* as desired, and would be understood by those skilled in the art as optional indicators of condition or state.

Figure 4:
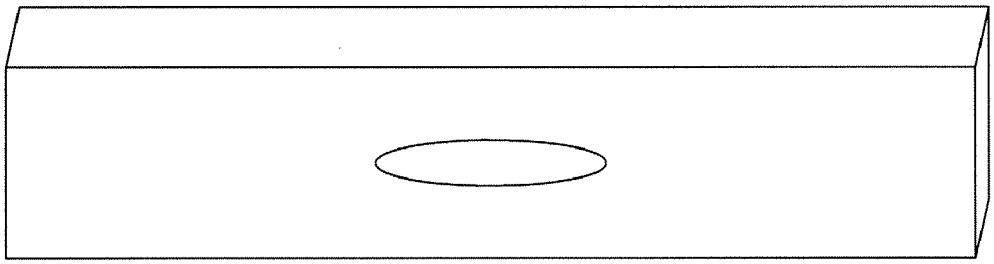
FIG. 4 is a diagram of a structure for carrying two spaced-apart detectors, releasably coupled thereto, in accordance with the invention.
Figure 4:
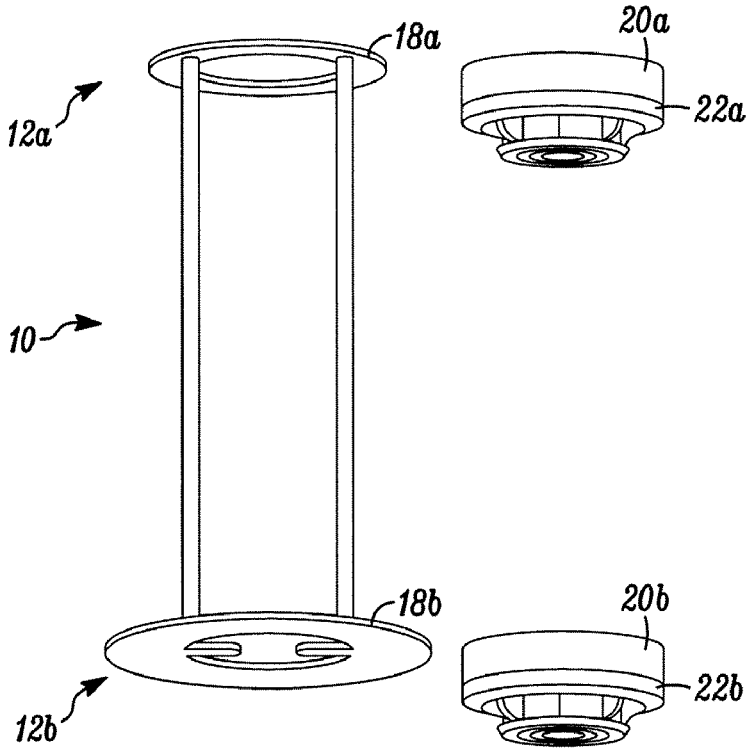

FIG. 4 illustrates the apparatus 10 with the bases 20*a*, 20*b* and detectors 22*a*, 22*b* decoupled therefrom. One of the advantages of the apparatus 10, 10' is that the detectors, such as 22*a,b* are standard detectors, and the bases 20*a,b* can be standard bases as would normally be used in such installations. No special equipment is necessary.

Relative to FIG. 4, instead of installing base 20*b*, either a decorative cover plate or light fixture could be installed on end 12*b*. In this embodiment, the base and detector 20*a*, 22*a* (upon installation) will extend into the utility region between the drop ceiling C and the actual ceiling. The observable end 12*b*, located below the drop ceiling C would display either the decorative cover plate or the light fixture. In either instance, if desired the light emitting diodes 30 could still be installed on end 12*b* to provide easily seen status indicia for the operational detector 22*a*. Other such variations come within the spirit and scope of the invention.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. An apparatus comprising:

first and second ambient condition detectors releasably coupled to first and second detector bases, respectively;

a structure including a plurality of axially extending and axially adjustable support members, the structure supports the detector bases axially spaced apart from one another along a common axis of the support members; and an annular member disposed on the structure between the first and second detector bases transverse to the common axis for mounting to a boundary between a first ambient region and a second ambient region, so that the first ambient condition detector extends into and senses an ambient condition in the first ambient region and the second ambient condition detector extends into and senses an ambient condition in the second ambient region wherein the first and second detectors independently monitor the first and second spaced apart regions, respectively.

2. An apparatus as in claim 1 where the structure carries a surface mounting feature.

3. An apparatus as in claim 1 where the detectors are in one of wired or wireless communication with a regional monitoring system.

4. An apparatus as in claim 1 where each of the support members has first and second ends, with one detector carried adjacent to one set of member ends, and, the other carried adjacent to the other set of member ends.

5. An apparatus as in claim 1 where the detectors are selected from a class which includes at least smoke detectors, fire detectors, gas detectors, condensation detectors, thermal detectors and intrusion detectors.

6. An apparatus as in claim 2 where the mounting feature comprises a plate.

7. An apparatus as in claim 6 where the plate is cylindrical.

8. An apparatus comprising:

first and second detector bases for releasably coupling first and second ambient condition detectors thereto;

an elongated connection structure with the bases each attached thereto, the elongated connection structure including a plurality of axially extending and axially adjustable support members, the bases axially spaced apart from one another along a common center line of the elongated connection structure; and an annular member disposed on the elongated connection structure between the first and second detector bases transverse to the common axis for mounting to a boundary between a first ambient region and a second ambient region, so that the first detector on the first detector base extends into and senses an ambient condition in the first ambient region and the second detector on the second detector base extends into and senses an ambient condition in the second ambient region.

9. An apparatus as in claim 8 which includes a member for attachment to a separate surface.

10. An apparatus as in claim 8 which includes an attachment plate carried at an end of the structure adjacent to one of the bases.

11. An apparatus comprising:

a first detector base for releasably coupling a detector thereto;

one of a decorative plate or a light fixture; and an elongated connection structure with the base attached thereto, the elongated connection structure including a plurality of adjustable and axially extending and axially adjustable support members, the base axially spaced apart from the decorative plate or the light fixture along a common center line of the elongated connection structure; and an annular member disposed on the elongated connection structure between the first detector base and the one of the decorative plate or the light fixture transverse to the common center line for mounting to a boundary between a first ambient region and a second ambient region, so that the detector attached to the first detector base extends into and senses an ambient condition in the first region and a second detector attached to the decorative plate or light fixture extends into and senses an ambient condition in the second ambient region.

12. An apparatus as in claim 11 which includes an element for attachment to a separate surface.

13. An apparatus as in claim 11 which includes an ambient condition detector couplable to the base.

* * * * *